US005490555A

United States Patent [19]

Korpela

[11] Patent Number: 5,490,555

[45] Date of Patent: Feb. 13, 1996

[54] METHOD OF CONTROLLING FORCES APPLIED TO A CONTINUOUSLY CAST PRODUCT

[75] Inventor: Thomas J. Korpela, Forest Hill, Md.

[73] Assignee: Vöest-Alpine Services and Technologies Corp., Pittsburgh, Pa.

[21] Appl. No.: 249,160

[22] Filed: May 25, 1994

[51] Int. Cl.[6] ..... B22D 11/20; B22D 11/12; B22D 11/128; B22C 19/04

[52] U.S. Cl. ..... 164/454; 164/442; 164/484; 164/154.5

[58] Field of Search ..... 164/441, 442, 164/413, 484, 452–454, 154.5

[56] References Cited

U.S. PATENT DOCUMENTS 5,018,569 5/1991 Burau et al. ..... 164/454

FOREIGN PATENT DOCUMENTS 1193826 9/1985 Canada ..... 164/442
450391 10/1991 European Pat. Off. ..... 164/442

*Primary Examiner*—P. Austin Bradley
*Assistant Examiner*—I. H. Lin
*Attorney, Agent, or Firm*—Hopgood, Calimafde, Kalil & Judlowe

[57] ABSTRACT

In a continuous casting system, there is provided an apparatus and a method for controlling the forces exerted by the foot rollers on the continuous casting slab. In accordance with one aspect of the present invention, the apparatus includes a hinged foot roller assembly and a hydraulic cylinder for moving the assembly toward and away from the slab. A linear variable differential transformer signals the cylinder to move the assembly relative to the slab such contact between the foot rollers and the slab edge is maintained at a selected contact force.

11 Claims, 8 Drawing Sheets

METHOD OF CONTROLLING FORCES APPLIED TO A CONTINUOUSLY CAST PRODUCT

DISCLOSURE OF THE INVENTION

The present invention relates to materials processing and more particularly to a method of controlling the forces applied to materials during continuous casting operations.

Typically, metals such as steel are formed into sheets or slabs for transportation and use in industrial applications. It has been found that the manner by which the metals are formed determines substantially the quality of the product.

During continuous casting, for instance, molten steel is poured into a mold defined by two sets of vertically disposed parallel face plates. After contacting the face plates (which are typically made of copper) a solidified skin is formed about the molten steel. This defines a semi-solidified steel slab. The slab moves down through the mold, the solidified skin gradually increasing in thickness. The slab next encounters a series of opposing, wide and narrow face rollers. Wide face rollers then carry the slab vertically down through the casting system, gradually placing it in a horizontal orientation for exiting the system. A casting system of this general configuration is shown, for example, in U.S. Pat. No. 5,297,612, issued Mar. 29, 1993, the disclosure of which is hereby incorporated by reference.

The narrow face foot rollers are typically arranged in series, e.g., 3 or 4 in number, and located just below the mold. The foot rollers are also set in a fixed position based upon an estimated location of the narrow face plates. This is usually done prior to casting operations. To further accommodate the slab width, the narrow face plates are tapered, i.e., set at an angle relative to the vertical axis. The angle of taper is typically a function of slab width, e.g., about 1% thereof. This taper, which commonly varies from 0.135 inches (30" narrow slab width) to 0.450 inches (100" wide slab width), determines, in part, the fixed position of the foot rollers.

Variation in the casting width, however, has caused operating problems. For example, as a result of uncertainties inherent in estimating the face plate location, the foot rollers were often set so far from the slab surface that, at relatively narrow casting widths, the face plates were not in contact with the slab. This defeated the purpose of the foot rollers. At relatively wide casting widths, the foot rollers were too close to the slab surface, causing excessive force to be exerted on slab edges. This often lead to breakage or tearing of its thin solidified shell; commonly known as a "breakout". Significant damage to the casting system resulted, at substantial cost to the manufacturer. It also limited the range of possible slab width variations during production. In addition, due to excessive wear, the narrow face copper plates are plated with nickel or chrome to prolong their operating life and that of the mold. This further adds to manufacturing costs.

Accordingly, the foot rollers have been set about half-way between the upper and lower width extremes of the slab to be produced. Springs were also installed in the foot rollers to cushion the load at these extremes. While this has prevented damage to the slab edges, it did not provide a constant uniform force over the entire width range of the slab during production. Bulging or tears in the slab surface were still common.

In accordance with one aspect of the present invention, there is provided, in a continuous casting system, an apparatus for controlling the forces exerted by the narrow face foot rollers on a continuously cast slab. The apparatus includes a hinged foot roller assembly and a cylinder for moving the assembly toward and away from the slab. A linear variable differential transformer signals the cylinder to move the assembly relative to the slab such that contact between the foot rollers and the slab edge is maintained at a selected contact force.

In accordance with another aspect of the present invention, there is provided, in a continuous casting system, a method of controlling the forces exerted by the narrow face foot rollers on a continuously cast slab. The method comprises the steps of sensing movement of a spring of a hinged foot roller assembly as the foot rollers encounter a width change in the slab being cast, and signaling a cylinder to move the assembly so as to maintain a selected contact force between the foot rollers and the slab edges.

Accordingly, it is an object of the present invention to provide an apparatus and method of controlling the forces exerted by the narrow face foot rollers on the edges of a continuously cast slab regardless of slab width and without damage to the casting system.

Another object of the present invention is to provide simple and efficient continuous casting operations.

Still another object of the present invention is to improve the quality of continuously cast products at a low cost.

The present invention will now be further described by reference to the following drawings which are not intended to limit the accompanying claims.

The same numerals are used throughout the figure drawings to designate similar elements.

Figure 1:
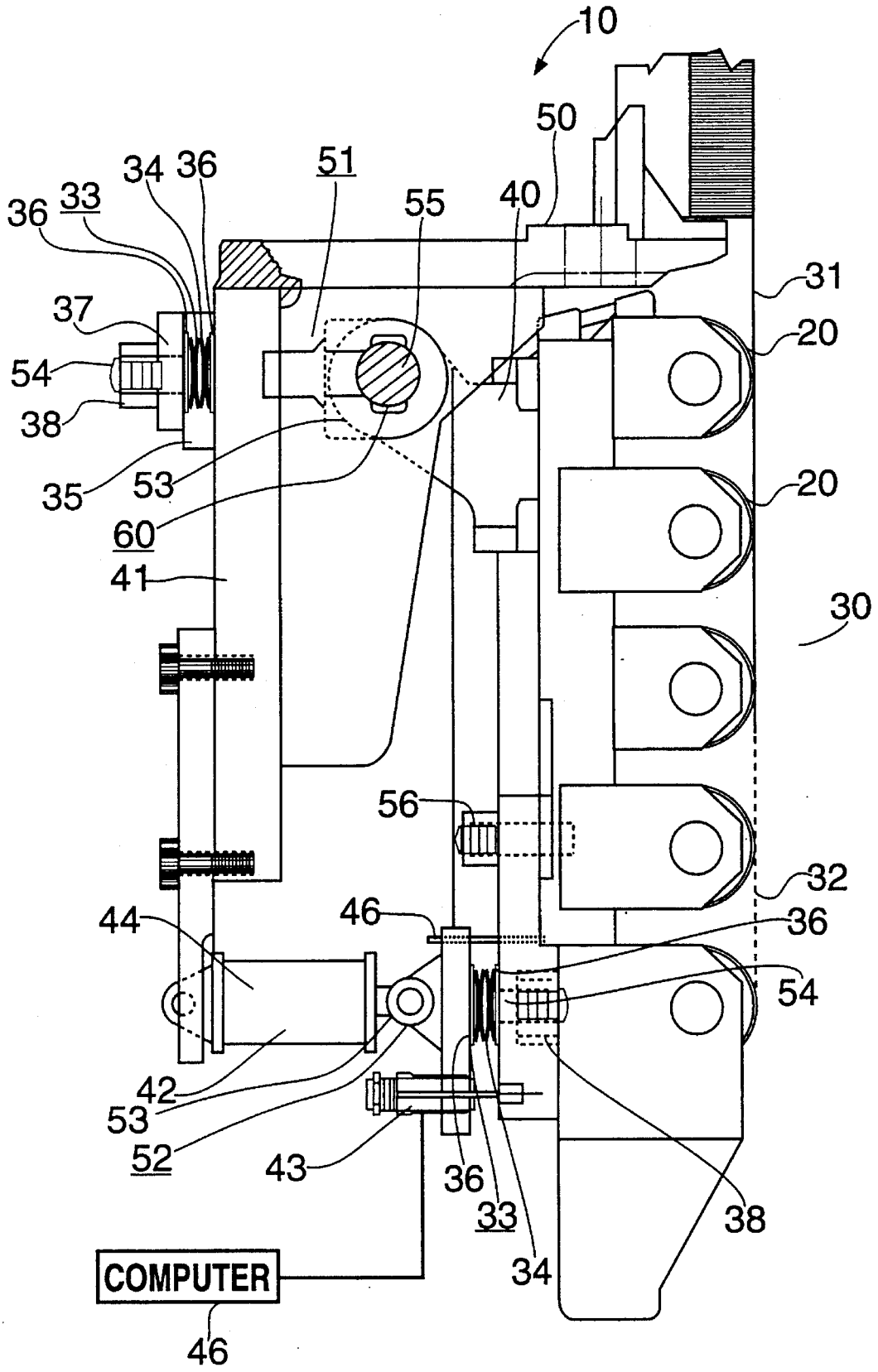
FIG. 1 is a side view of an adjustable hinged foot roller assembly, in accordance with one aspect of the present invention.
Figure 1A:
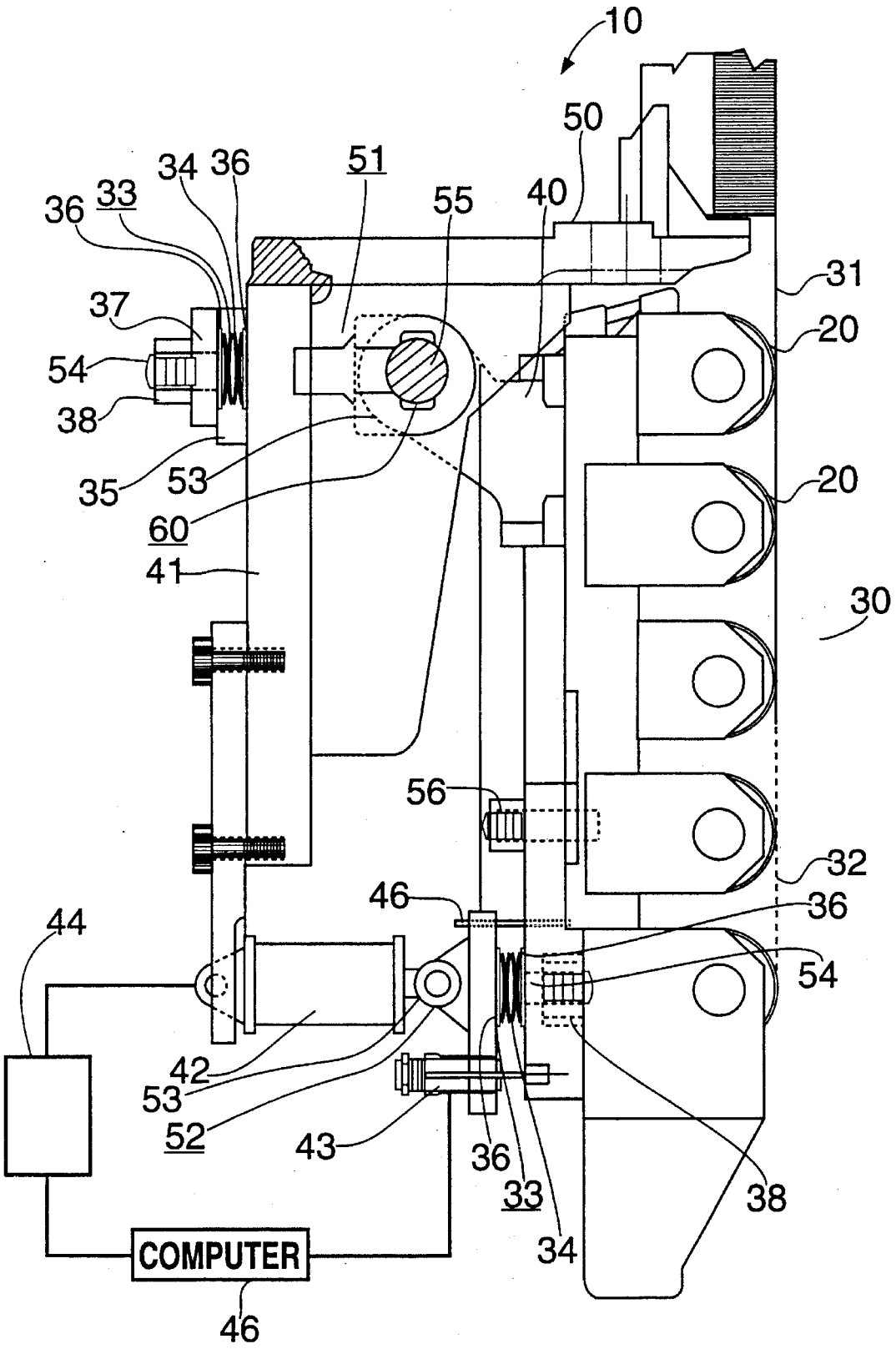
FIG. 1A is a side view of an adjustable hinged foot roller assembly, in accordance with another aspect of the present invention.

Still other objects and advantages of the present invention will become apparent from the following description of the preferred embodiments.

Referring now to the drawings and more particularly to FIGS. 1–7, there is shown generally an apparatus 10 for controlling the forces exerted by narrow face foot rollers 20 on a continuously cast slab 30, in accordance with various aspects of the present invention. The apparatus includes a hinged foot roller assembly 40, a mounting bracket 41, and a cylinder 42 for moving the assembly toward and away from the slab. A linear variable differential transformer 43 (or LVDT) signals the cylinder to move the assembly relative to the slab such that contact between the foot rollers and the slab edge 31 is maintained at a selected uniform contact force.

In accordance with another aspect of the present invention, there is provided, in a continuous casting system, a method of controlling the forces exerted by narrow face foot rollers 20 on a continuously cast slab 30. The method comprises the steps of sensing movement of a disc spring 34 of hinged foot roller assembly 40 as the foot rollers encounter a width change in the slab being cast, and signaling cylinder 42 to move the assembly such that contact between the foot rollers and the slab edges is maintained at a selected contact force.

The cylinder preferably operates hydraulically and is of sufficient size to exert a force necessary for moving the foot roller assembly about a hinge or pivot point 60. The cylinder is actuated by a proportional valve 44 upon receiving a signal from the LVDT 43. The proportional valve meters hydraulic fluid to the cylinder in relatively exact amounts in order to maintain and control forces on the slab edge.

Figure 2:
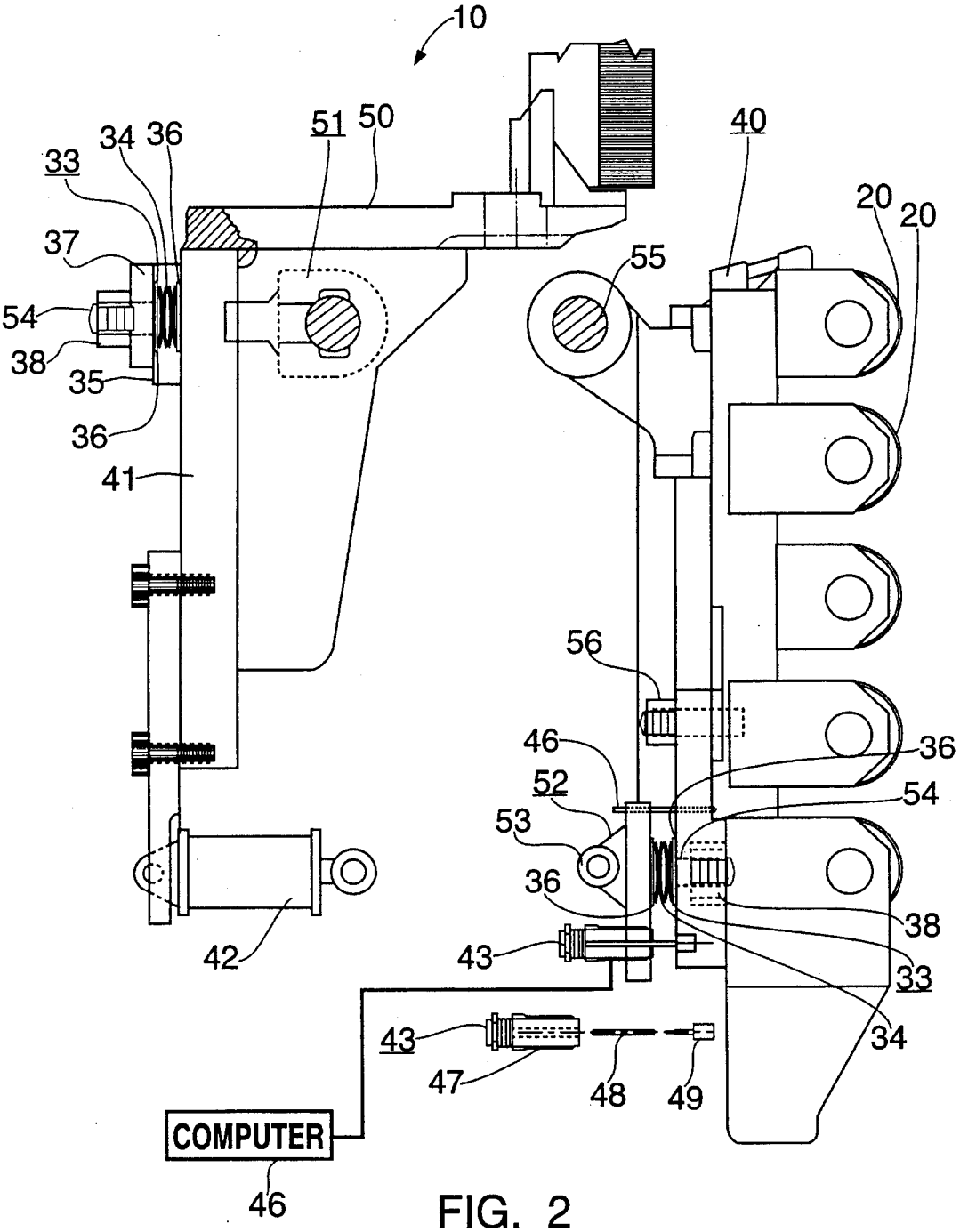
FIG. 2 is a side view of the components of FIG. 1.
Figure 3:
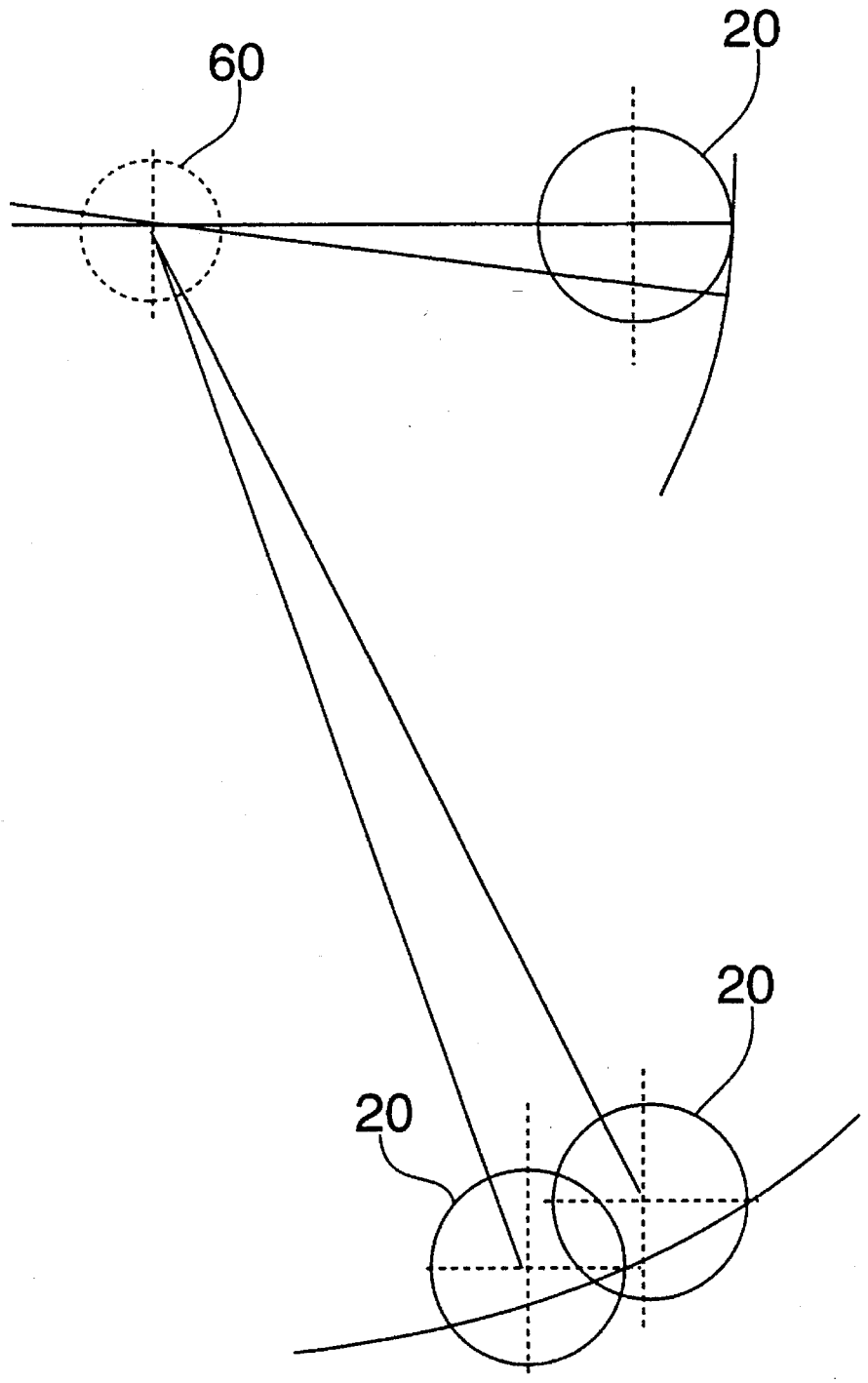
FIG. 3 is a kinematic diagram of the assembly of FIG. 1.
Figure 4:
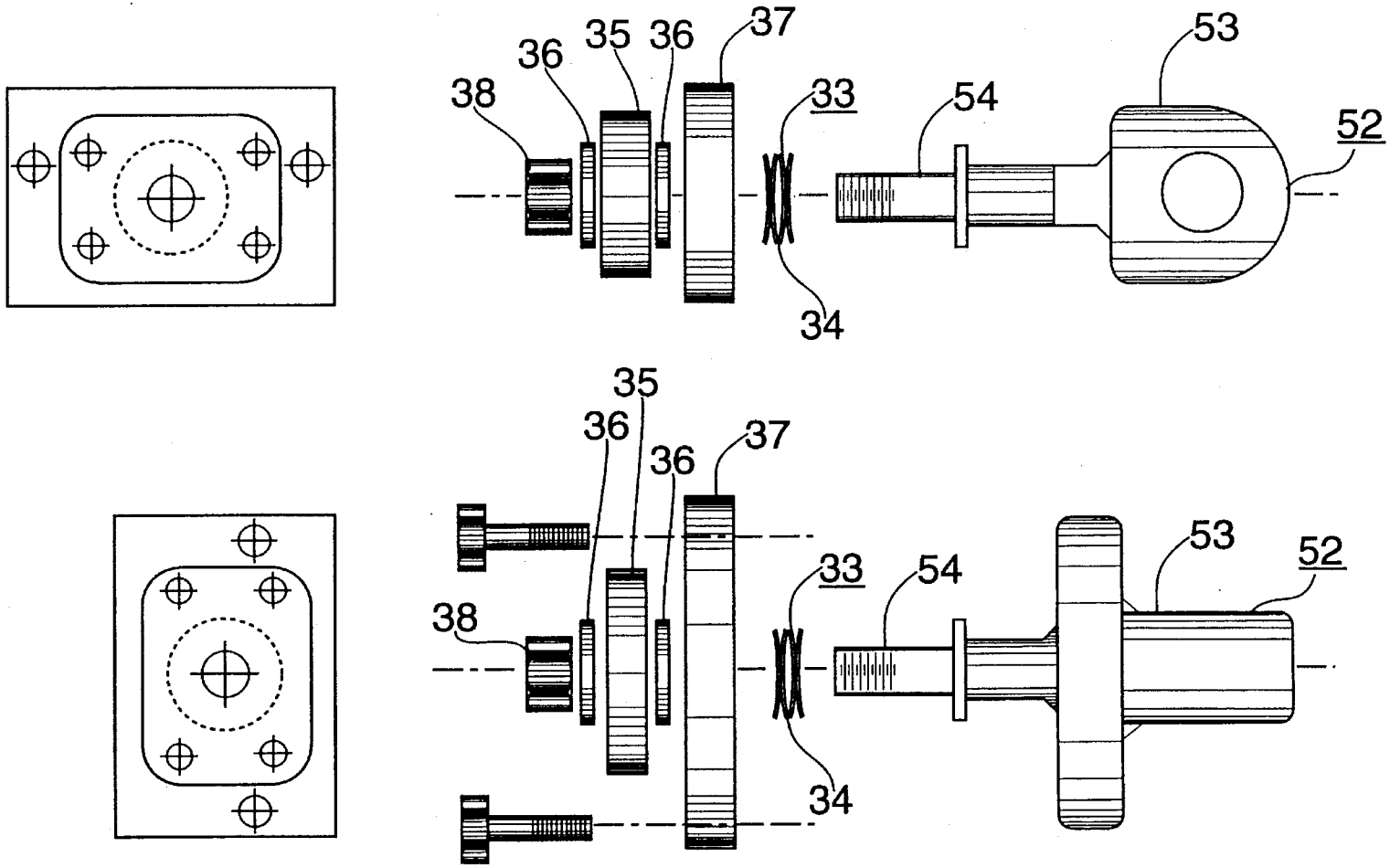
FIG. 4 shows two side views of the disc spring assembly of FIG. 1.

It is preferred that the LVDT be located in proximity to the lower portion of the foot roller assembly, adjacent to a disk spring assembly 33. In accordance with one aspect of the present invention, the assembly of LVDT 43 is mounted in a housing 47 adjacent the bottom foot roller. The assembly typically comprises a relatively short cylindrical body with a core 48 and core holder 49 located on the body interior. This is best seen in FIG. 2. The assembly's location, adjacent the lower disc spring assembly, permits ready detection of disc spring compression.

Although the present invention is shown and described as using an LVDT, other electronic devices which measure relatively small mechanical movements, and convey such information to a computer 46 (or computerized network) which provides the necessary control limits of the system, is considered within the spirit and scope of the present invention. In accordance with one aspect of the invention, the computer/computerized network is a Series 6 Plus computer.

During continuous casting operations, the cylinder moves the foot roller assembly in and out of a theoretical edge 32 (commonly known as the "pass line") of the cast slab. Displacement of the foot roller occurs until contact is made with the slab narrow face or edge. Disk spring assembly 33 then encounters the load and starts to compress. This pushes the foot roller assembly against the edge of the slab, the LVDT measuring the associated disc spring movement (e.g., compression). When sufficient force has been applied, the LVDT automatically senses compression of disc spring 34, and signals the proportional valve to stop the cylinder and maintain the force exerted. LVDT measurements are preferably based upon the spring constant of the disc spring assembly (in lbs. of force/0.001" movement). The calculated and measured force exerted by the foot roller assembly is then maintained relatively constant throughout the casting operation, regardless of slab width.

As best seen in FIGS. 1 and 2, apparatus 10 is equipped with upper and lower yoke assemblies 51, 52, each pivotally connecting foot roller assembly 40 to bracket 41. The bracket, in turn, is mounted, e.g., bolted and keyed, to narrow face plate assembly 50 of a continuous casting mold.

Each yoke assembly comprises a yoke 53 adapted for receiving a disc spring assembly 33. Yoke arm 54 passes through disc spring 34 which itself is inside a hollowed portion of a first end plate 35 and bounded at each end by hardened washers 36. The washers are preferably constructed of steel. A second end plate 37 abuts the first endsplate and is secured to the yoke, for instance, by a hex nut 38.

The upper yoke assembly pivotally mounts a top pin connector 55 of foot roller assembly 40. Hence, as the foot roller assembly pivots about the upper yoke and pin, the foot rollers move in and out of the pass line.

At the bottom of the foot roller assembly is bottom yoke assembly 52 which is pivotally mounted to hydraulic cylinder 42. Actuation (and displacement) of the cylinder causes the assembly to pivot about the pin connector (and associated movement of the foot rollers). This movement, in turn, compresses the lower disc spring 34. As changes in slab width are encountered, compression of the lower disc spring is sensed by the LVDT which signals the hydraulic cylinder to move accordingly. During spring compression, movement is guided by guide rod 46.

Although the present invention is shown and described in combination with a hydraulic cylinder, it is understood that movement of the foot roller assembly, i.e., the forces exerted by the assembly on the slab, may be controlled by other mechanical and/or electrical devices, giving consideration to the purpose for which the present invention is intended. For example, a ball screw arrangement is also considered within the spirit and scope of the present invention.

An objective of the invention is to insure quality, i.e., squareness of the slab product without bulging or tears in its solidified skin. This may be done not only by controlling the forces exerted by the mold sidewalls during casting, but also controlling the forces exerted by the foot rollers on the slab. In this connection, the arrangement of the present invention has been found desirable for maintaining a constant uniform force during the entire width range of the slab product.

Figure 6:
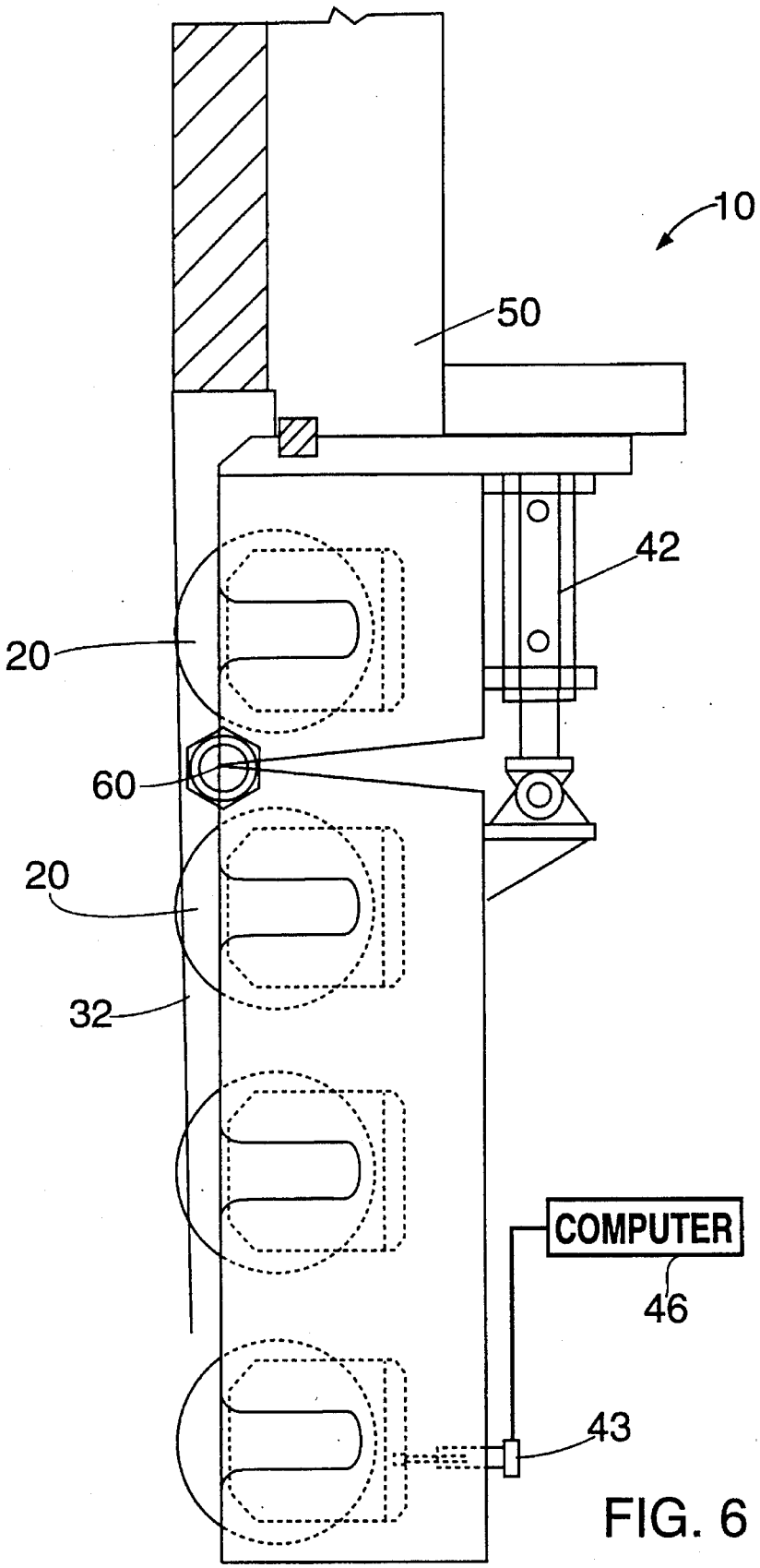
FIG. 6 is a side view of the assembly of FIG. 1, in accordance with yet another aspect of the present invention.
Figure 7:
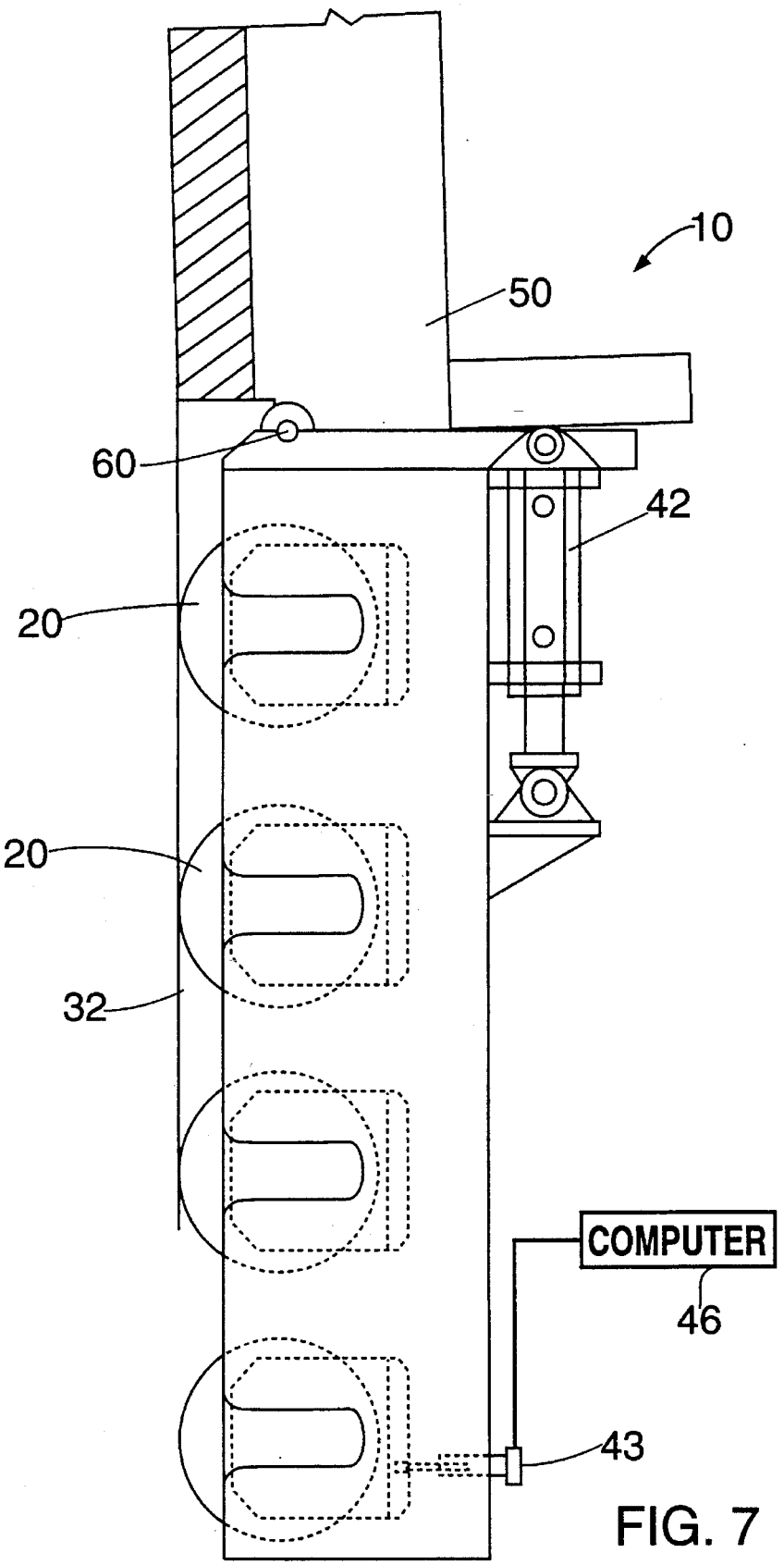
FIG. 7 is a side view of the assembly of FIG. 1, in accordance with still another aspect of the present invention.

In accordance with another aspect of the present invention, the cylinder is mounted vertically, as shown in FIGS. 6–7. This orientation has been found suitable when casting a relatively wide slab product, given the limited clearance usually associated with the position of the narrow face foot rollers.

In the embodiment of FIGS. 1 and 2, the clearance is generally sufficient. This allows the cylinder to be mounted in the horizontal position, which is preferred. It has been found that cylinder size may be reduced substantially if its moment arm is relatively large and further from the hinge or pivot point 60 of the foot roller assembly.

In an alternative embodiment of the present invention, the pivot point is moved upwardly. Increasing the moment arm of the assembly has been found to improve assembly control and decrease energy consumption.

In operation, the operator sets the desired force of the foot roller assembly against the edges of the slab. The present invention then maintains this force throughout casting operations. This reduces bulging of the slab edges and minimizes the possibility of slab shell break-out. Excessive wear generated on the narrow face plate lower section is also significantly reduced. Should the top foot roller come into contact with the slab edge during width change, or with the steel starter head during start-up, the present invention provides any needed flexibility and movement for preventing damage to the slab product.

Figure 5:
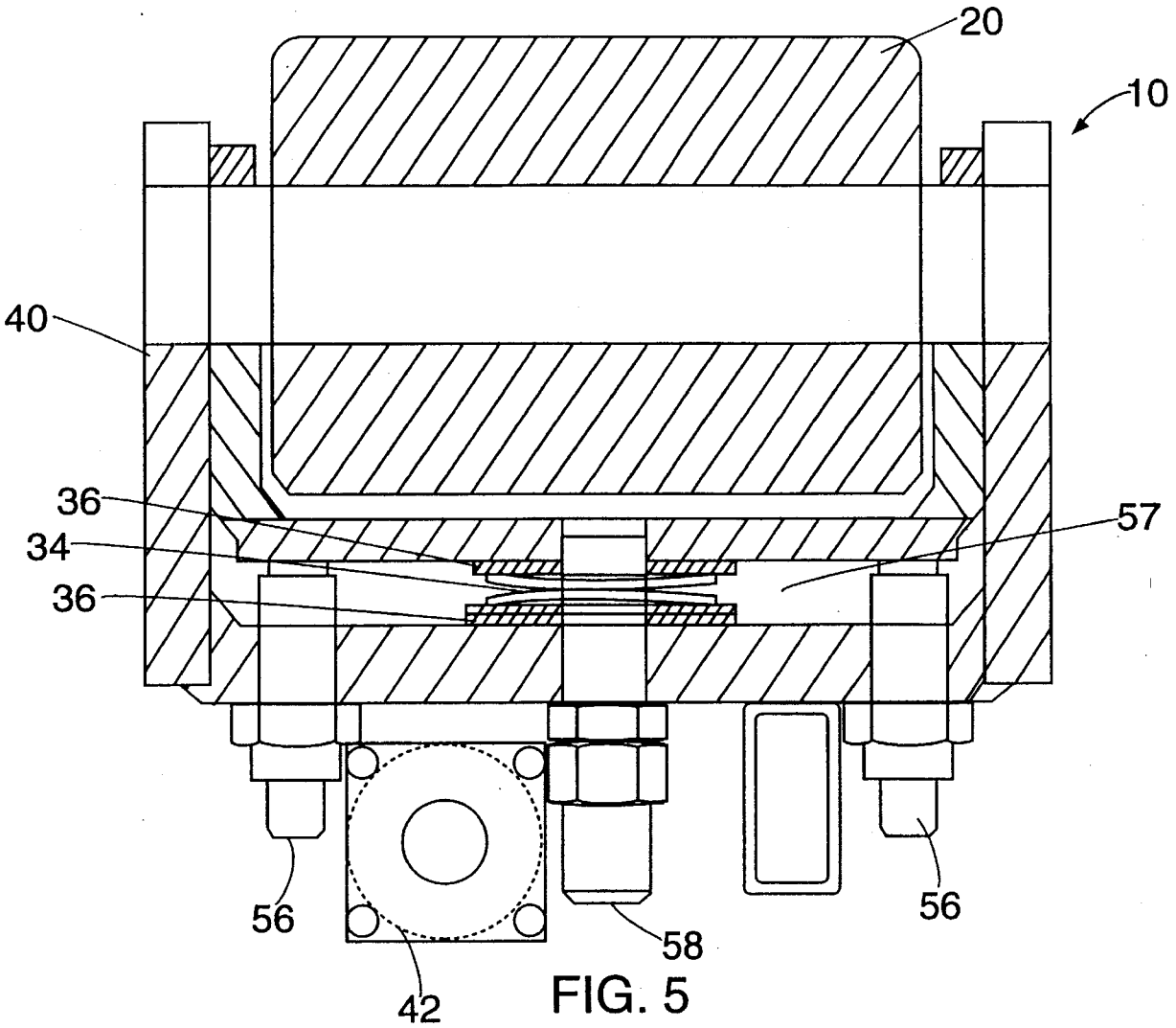
FIG. 5 is a top view of the disc spring and roller assembly of FIG. 1, in accordance with another aspect of the present invention.

Alternatively, as provided in FIG. 5, the top rollers of the foot roller assembly are preloaded at a selected force during set up, then left in a free state. This may be done using adjusting screws 56 to move the rollers into the passline. When adjustment is complete, gap 57 is measured to determine the appropriate shims for obtaining the desired preload. Then, knowing the gap size and the spring constant of the disc spring, stud rod 58 is tightened until the roller frame contacts the adjusting screw. In this position, the rollers are at the desired passline and have the desired preload. Preferably, the adjusting screws are backed off, e.g., about 0.25 inch, before proceeding. The remaining foot rollers are set in the same manner as the top rollers, but with no preload.

Next, the foot rollers are pulled back, e.g., about 2 inches, until casting has begun. Once the casting system has been ramped up to speed, the foot rollers are adjusted into contact with the slab edge. This is done by activation of the hydraulic cylinder. The force generated on the slab edge has been found a function of the disc spring constant and LVDT movement. By the present invention, this force is maintained regardless of slab width.

During width change operations, the foot rollers are pulled back, e.g., about 2 inches, just prior to the width change and are not adjusted against the slab edge until width change operations have concluded.

Generally speaking, the preload force depends on the operating practice of the caster. The top roller is individually set due to its limited range of movement when the foot roller assembly is rotated out of the pass line during width change operations. The same is true during start-up or turnaround upon insertion of a steel starter bar head into the mold cavity.

The present invention improves slab quality by improving straightness, flatness, and shape with minimal variation. This is done by maintaining a desired force on the narrow face foot roller assembly (and against the edges of the cast slab) regardless of either the slab width or the degree of taper applied to the narrow face plates during casting. Quality in subsequent working and/or machining of the metal is thereby insured, and by maintaining production, costs are lower. Also, substantial wear reduction in the narrow face plates is achieved, lowering costs further. In this manner, the present invention advantageously provides cost-effective mass production of high quality continuously cast products for heavy industrial applications and the like.

Although the embodiments illustrated herein have been shown and described for use in casting steel or the like, it is understood that an analogous process could be practiced on other metals, giving consideration to the purpose for which the present invention is intended.

The above-described arrangement and methodology is merely illustrative of the principles of the present invention. Numerous modifications and adaptations thereof will be readily apparent to those skilled in the art without departing from the spirit and scope of the present invention. For example, although the present invention has been described as being adapted for casting metal products and the like, it is understood that any material could be cast giving consideration to the purpose for which this invention is intended. In addition, while a rectangular, variable width mold has been described for operation in a vertical orientation, it is also understood that any suitably oriented or configured mold could be utilized consistent with the principles set forth herein.

What is claimed is:

1. In a continuous casting system, an apparatus for dynamically controlling the forces exerted by the foot rollers on the continuous casting slab, the apparatus comprising:

a hinged foot roller assembly;

a cylinder for moving the assembly toward and away and away from the slab; and an electronic sensor for signaling the cylinder to move the assembly relative to the slab such that contact between the foot rollers and the slab edge is maintained at a selected contact force regardless of slab width and without deformation of the slab or damage to the casting system, wherein the cylinder is oriented perpendicularly relative to the narrow face plates of the casting system.

2. The apparatus set forth in claim 1 wherein the cylinder operates hydraulically.

3. The apparatus set forth in claim 1 wherein the foot rollers are coincident with the narrow face plates of the casting system.

4. The apparatus set forth in claim 1 wherein a proportional value controls movement of the cylinder.

5. The apparatus set forth in claim 1 wherein the electronic sensor is a linear variable differential transformer.

6. In a continuous casting system, a method of dynamically controlling the forces exerted by the foot rollers on the narrow face of the continuous casting slab, which comprises the steps of sensing movement of a spring of a hinged foot roller assembly as the foot rollers encounter a width change in the slab being cast and signaling a hydraulic cylinder to move the assembly such that a selected contact force between the foot rollers and the slab edges is maintained at a selected contact force regardless of slab width and without deformstick of the slab or damage to the casting system.

7. In a continuous casting system, an apparatus for dynamically controlling the forces exerted by the narrow face foot rollers on the continuous casting slab, the apparatus comprising:

a hinged foot roller assembly;

a hydraulic cylinder for moving the assembly toward and away from the slab; and a linear variable differential transformer for signaling the cylinder to move the assembly relative to the slab such that contact between the foot rollers and the narrow face of the slab edge is maintained at a selected contact force regardless of slab width and without deformation of the slab or damage to the casing system.

8. The apparatus set forth in claim 7 wherein the foot rollers are coincident with the face plates of the casting system.

9. The apparatus set forth in claim 7 wherein the cylinder is oriented perpendicularly relative to the narrow face plates.

10. The apparatus set forth in claim 7 wherein a proportional value controls movement of the cylinder.

11. In a continuous casting system, an apparatus for controlling the forces exerted by the foot rollers on the narrow face of the continuous casting slab, the apparatus comprising:

a hinged foot roller assembly;

a cylinder for moving the assembly toward and away from the slab; and a computer controlled electronic device for measuring relatively small mechanical movements of the foot roller assembly and, in response, signaling the cylinder to move the assembly relative to the slab such that contract between the foot rollers and the narrow face of the slab edge is maintained at a selected contact force regardless of slab width and without deformation of the slab or damage to the casting system.

* * * * *